US008240535B2

(12) United States Patent
Shor

(10) Patent No.: US 8,240,535 B2
(45) Date of Patent: Aug. 14, 2012

(54) STAPLE GUN WIRE GUIDE

(75) Inventor: Ilya Shor, Brooklyn, NY (US)

(73) Assignee: Arrow Fastener Co., LLC, Saddle Brook, NJ (US)

( * ) Notice: Subject to any disclaimer, the term of this patent is extended or adjusted under 35 U.S.C. 154(b) by 88 days.

(21) Appl. No.: 12/946,496

(22) Filed: Nov. 15, 2010

(65) Prior Publication Data

US 2012/0118934 A1 May 17, 2012

(51) Int. Cl.
*B25C 5/02* (2006.01)

(52) U.S. Cl. ..... 227/140; 227/142; 227/151

(58) Field of Classification Search ..... 227/109, 227/140, 132, 142, 151, 152, 119, 156
See application file for complete search history.

(56) References Cited

U.S. PATENT DOCUMENTS

| | | | | |
|---|---|---|---|---|
| 2,947,003 | A * | 8/1960 | Ericsson | 227/123 |
| 3,510,043 | A | 5/1970 | Larson | |
| 4,552,296 | A * | 11/1985 | Sheng | 227/109 |
| 5,014,897 | A | 5/1991 | Uuskallio | |
| 5,094,380 | A | 3/1992 | Nasiatka | |
| 5,219,110 | A * | 6/1993 | Mukoyama | 227/8 |
| 5,263,626 | A * | 11/1993 | Howard et al. | 227/8 |
| 5,491,899 | A | 2/1996 | Schliemann et al. | |
| 5,735,444 | A | 4/1998 | Wingert | |
| 5,785,227 | A * | 7/1998 | Akiba | 227/8 |
| 5,826,853 | A | 10/1998 | Anello et al. | |
| 5,884,829 | A | 3/1999 | Wingert | |
| 6,082,604 | A | 7/2000 | Dennis | |
| 6,131,788 | A * | 10/2000 | Marks | 227/132 |
| 6,866,177 | B1 * | 3/2005 | Chen | 227/142 |
| 7,011,242 | B2 | 3/2006 | Barlow et al. | |
| 7,562,801 | B2 | 7/2009 | Pelletier et al. | |

FOREIGN PATENT DOCUMENTS

WO WO2009/111094 A1 9/2009

* cited by examiner

*Primary Examiner* — Scott A. Smith
(74) *Attorney, Agent, or Firm* — Lora Graentzdoerffer; Niravkumar Parikh; Edgar Zarins

(57) ABSTRACT

A staple gun tacker includes a wire guide mechanism in its forward end which includes a wire guide plate having a recessed lower end for engaging a wire when the plate is in an extended position and a rotatable cam for moving the plate between extended and retracted positions which includes a circular slot formed therein having one end thereof located closer to the axis of rotation of the cam then the other receiving and engaged with a projection on the cam plate so that rotation of the cam is translated into linear movement of the wire guide plate.

11 Claims, 3 Drawing Sheets

STAPLE GUN WIRE GUIDE

BACKGROUND

1. Technical Field

The multiple embodiments disclosed herein are directed towards the field of staple guns, and more particularly to a wire guide element for positioning the staple driving end of a staple gun tacker with respect to a wire or cable to be stapled to a workpiece.

2. Description of Related Art

Staple guns are well known hand-held tools adapted to drive staples into a workpiece. Arrow Fastener Co. manufactures and sells numerous models of such devices, including the manually operated non-powered staple gun sold under the T-50® brand name, and more recently powered models, such as the cordless CT-50™ staple gun.

It is known to provide a wire guide for a staple gun, as disclosed for example in U.S. Pat. No. 5,884,829, and U.S. patent application Ser. No. 12/920,395, filed Aug. 31, 2010 both of which are assigned to the Arrow Fastener Co. and incorporated herein by reference. A wire guide is an element having a recessed surface that fits around a wire or cable to be stapled to a wall or workpiece to position the staple gun so that a staple can be driven reliably over the wire or cable to attach it to the workpiece. The wire guide itself typically has surfaces on either side of the recess which receives the wire or cable that are positioned against the surface to be stapled during the staple driving operation. These serve to space the staple driving end from the wire to prevent the staple bight from being driven into the wire.

Previously proposed wire guide devices have been somewhat complicated to manufacture and cumbersome to use. For example the guide disclosed in U.S. Patent Publication No. 2007/0039994 uses a rotatable dial having a partially gear toothed peripheral surface that engages a pivotally mounted guide. The dial extends from one side of the staple gun and, when rotated, rotates the guide into or out of the staple gun housing. This requires a somewhat wider front housing than normal and the dial is difficult to operate. In addition, a separate, preferably spring biased retaining structure is required to functionally retain the dial so that the guide is held in its deployed or retracted position.

The staple guide of U.S. patent application Ser. No. 12/920,395, discussed above, is somewhat simpler but also requires multiple components, including a separate spring. That device uses a rotatable knob or switch to rotate a generally oval cam which drives the wire guide into or out of the housing. The knob is located on the front of the housing and has a small protrusion for the operator to use to turn the knob. This is difficult to do, particularly in work gloves.

BRIEF SUMMARY

In an embodiment, a wire guide mechanism for a staple gun is disclosed which uses a minimal number of parts and is easily operated to extend and retract the wire guide element from the staple gun housing.

In at least one embodiment disclosed herein a staple gun tacker wire guide device of the character described is relatively simple in construction and reliable in use.

A staple gun tacker wire guide of the character described herein may require minimal modification of the staple gun and is inexpensive to manufacture.

In accordance with an embodiment of a staple gun tacker, such as, without limitation, the T-50® brand stapler made by Arrow Fastener Co., a wire guide mechanism may be positioned in the forward or driving end of the staple gun adjacent the staple driver. The mechanism includes a cam rotatably mounted on an axis that is generally perpendicular to the staple driver and a substantially planar wire guide. The wire guide has a free end including a recess adapted to be positioned over a wire or cable, and it is adapted to be moved between extended and retracted positions by the cam when it is rotated. The cam is generally circular and its periphery extends out of openings in the sides of the staple gun housing to permit the operator to conveniently turn it on its axis.

The cam has a generally semi circular slot formed therein which has one end radially closer to the axis of rotation of the cam than its other end. The slot receives a protuberance or pin on the wire guide. When the cam is rotated the engagement of the protuberance or pin on the slot causes the wire guide to move linearly in the housing between extended and retracted positions. This structure provides a simple and easily operated wire guide feature in the staple gun.

The above and other objects, features and advantages of this invention will be apparent in the following detailed description of the illustrative embodiments thereof, which is to be read in connection with the accompanying drawings, wherein:

DETAILED DESCRIPTION OF THE INVENTION

Unless stated otherwise, directions are used herein with reference to the normal orientation of the staple gun. Thus, the operating handle or lever is at the top of the device, and the direction toward the top is "up." The staple driver is oriented vertically, located toward the "front" of the gun; staples come out of the "bottom" of the staple gun through a discharge opening, and the direction toward the bottom is "down."

Figure 1:
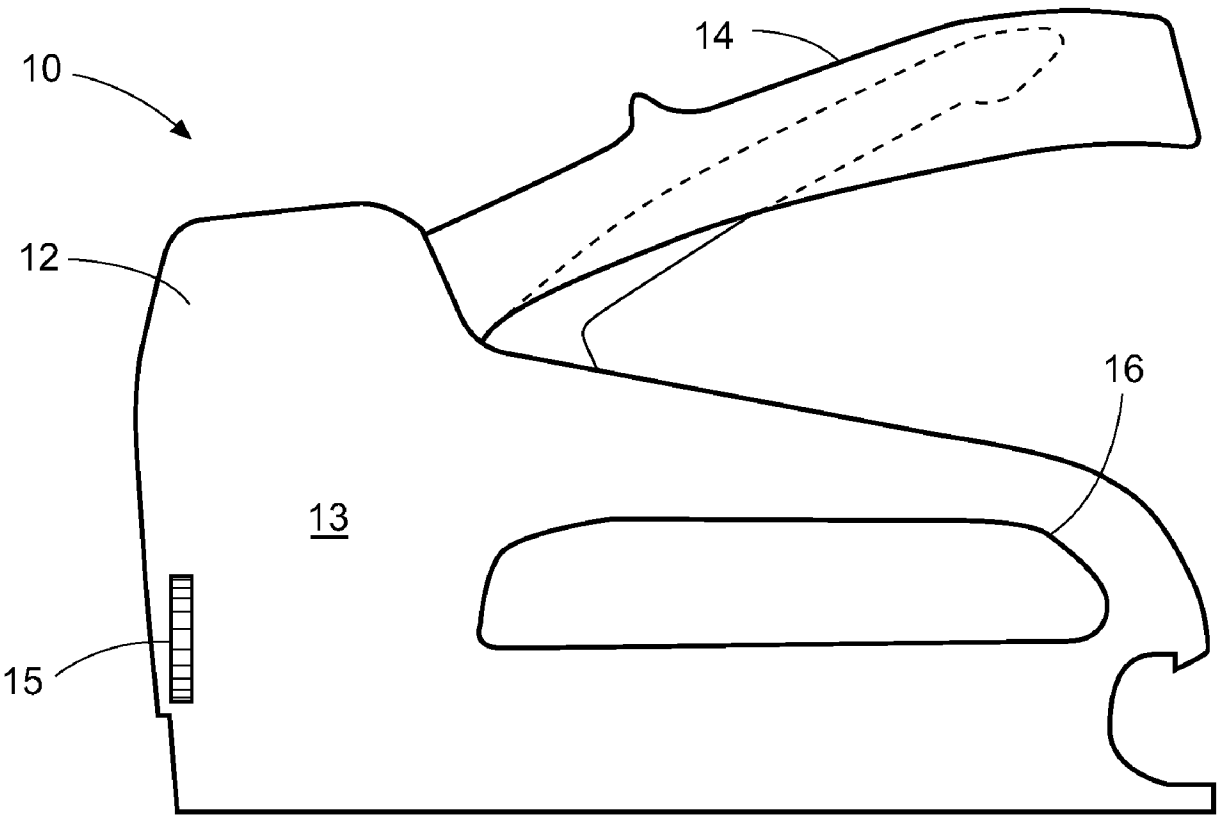
FIG. 1 is an elevational view of a staple gun incorporating a wire guide apparatus.
Figure 4:
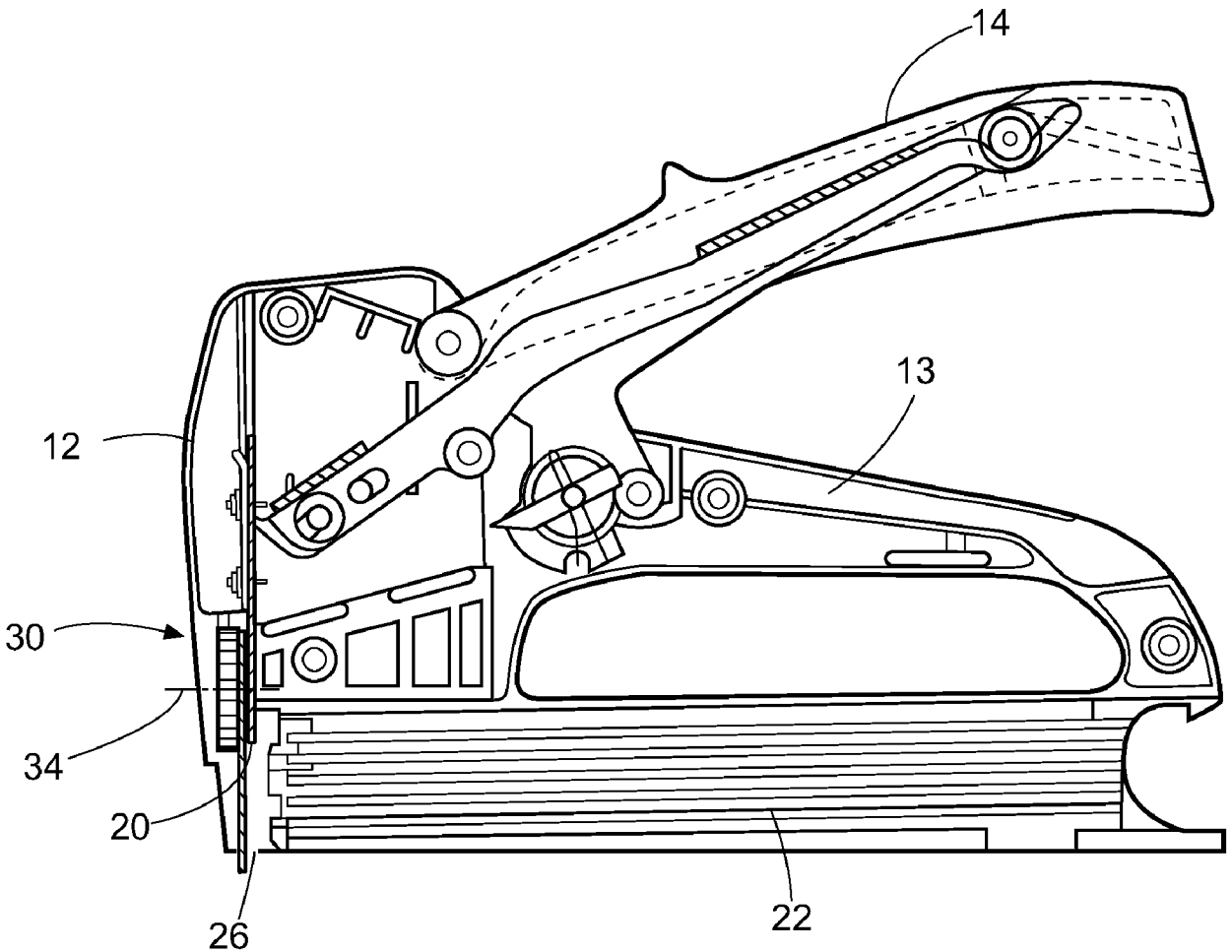
FIG. 4 is an elevational view, similar to FIG. 1, with the side housing removed and taken along line 4-4 of FIG. 2 with the wire guide in the extended position.

Referring now to the drawings in detail, and initially to FIG. 1, a staple gun tacker 10 of generally conventional and known construction is illustrated. The staple gun includes a housing 12, an operating lever or handle 14, and a finger hole opening 16. The interior of the housing contains an activating lever system 18 of known construction as illustrated in FIG. 4 which, when operated by the user depressing the handle 14, drives the staple driver or plate, sometimes referred to as the "knive," 20 downwardly to engage a staple in the staple supply track 22 and drive it out of the track through a staple driving opening 26 in the bottom of the housing. Such staple driving arrangements are well known to those skilled in the art, and therefore are not described herein in detail.

Figure 2:
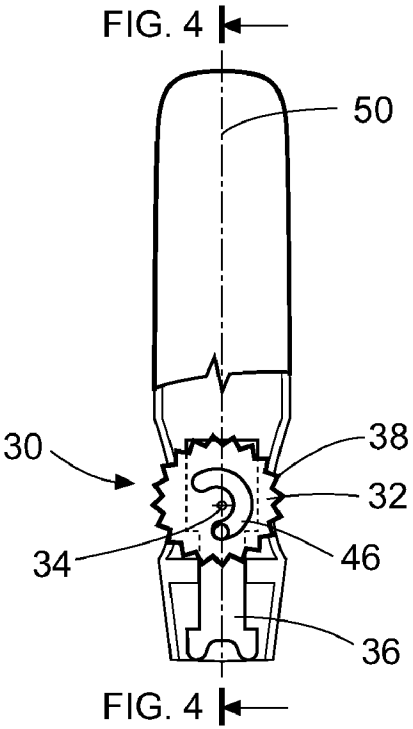

A seen in the detail view of FIGS. 2 and 4 a wire guide mechanism 30 is located in housing 12 immediately in front of the driver plate 20. The wire guide mechanism includes a flat, circular cam plate 32 which is rotatably mounted in any convenient manner in housing 12, for example on a pin or rivet secured in the housing in any convenient manner.

Figure 5:
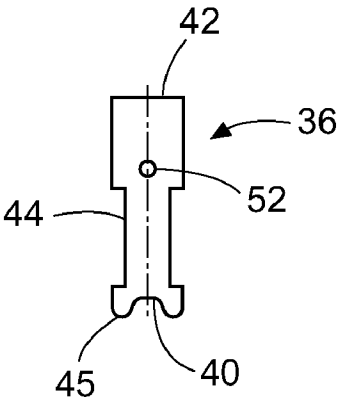
FIG. 5 is a plan view wire guide plate.

The rotatable mounting of the cam is on an axis of rotation that is perpendicular to driver 20 and to a wire guide plate 36, shown in detail in FIG. 5. The peripheral edge 38 of cam plate 32 is knurled and extends beyond the sides 13 of housing 12 through slots or opening 15 formed therein so that the user can conceivably and easily rotate the cam plate on its axis.

Figure 3:
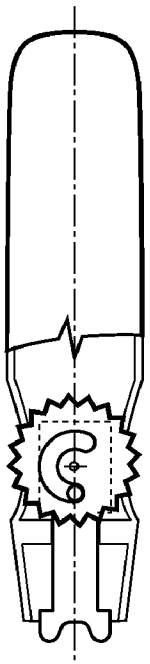
FIGS. 2 and 3 are front views of the staple gun tacker with part of the cover removed to show the wire guide in its retracted and extended positions respectively.

In the embodiment shown, the cam plate is rotatable between first and second positions, corresponding to respective first (extended) and second (retracted) positions of the wire guide plate 36 so that the free or bottom end of the wire guide is either not extended from the bottom of the staple gun, as shown in FIG. 2, or is extended from the bottom of the staple gun, and ready to be used, as shown in FIG. 3. This enables convenient use of the staple gun without the wire guide, in a case where it is not needed for stapling a cable or wire. In those instances, the wire guide is set to its retracted position.

As seen in FIG. 5 the lower end of the wire guide plate has support surfaces 47 on either side of the recess 40. These surfaces are generally flat and engage the workpiece during a stapling operation. This spaces the driving opening from the workpiece while holding the wire in a fixed position. As a result the staple legs are driven adjacent the wire but the bight of the staple is not driven down to the workpiece, thereby avoiding damage to the wire.

The distance between the two surfaces 45 on opposite sides of recess 40 is not critical, and may be, for example, in a range of about 6.0 mm to about 8.0 mm. Likewise, the distance from the top of the recess to the surfaces is not limited. This distance may conveniently be in a range of about 5.0 to 7.0 mm. The top of the recess may be any shape, such as arcuate shape as shown. In the illustrated embodiment the top of the cutout is essentially in the shape of a semicircle.

The wire guide plate 36 may be planar so that it can be accommodated in a low profile housing. Its upper end 42 has lateral extensions 44 which are adopted to slide in tracks, grooves or the like on the inner surfaces of housing 12 to move linearly between the extended and retracted positions shown in FIGS. 2 and 3.

In order to move the wire guide plate cam 36 is formed with a generally semicircular slot 46 whose arcuate angular extent is slightly more than 180°. As seen in FIGS. 2 and 3 the slot 46 has two ends, one of which is radially closer to the axis of rotation of cam 32 than the other. These ends are located so that one is on the vertical axis of symmetry to the plate in its path of travel in the retracted position of FIG. 2 and the other end is in that position in the extended position.

The rotation of the cam 32 is translated into the linear movement of the wire guide plate by means on the wire guide plate for engaging the cam in the slot. This means may be an integral protuberance 52 formed in the plate or a pin mounted in the plate and extending into the slot, or the like.

In the illustrated embodiments, the protuberance is circular and the ends of slot 46 are complementary to it. These elements are dimensioned to achieve a friction fit to help hold the plate firmly in its extended and retracted positions.

Preferably slot 46 has an arcuate extent of more than 180°, say 180° to 210°, so that a secure stop or locking function is provided to resist movement of the plate in its extended or retracted positions, except upon rotation of the cam.

Although at least one illustrative embodiment has been described herein with reference to the accompanying drawings, it is to be understood that various changes and modifications may be effected therein by those skilled in the art without departing from the scope or spirit of this invention.

What is claimed is:

1. A staple gun tacker for driving staples comprising:

a housing having a staple driving end including a staple discharge opening;

a wire guide mounted in said housing at said staple driving end adjacent to the staple discharge opening for linear movement between extended and retracted positions, said wire guide having a free end including a recess for receiving a wire to be stapled to a workpiece and a pair of support surfaces respectively located on either side of the recess; said free end being located outside the housing and beneath the driving end thereof in the extended position of the wire guide and adjacent said discharge opening in the retracted position; and means for moving said wire guide generally linearly between said extended and retracted positions comprising a cam member rotatably mounted in the housing adjacent the path of travel of the wire guide, said cam member having an edge portion which extends laterally out of the housing on opposite sides of the housing to permit manual rotation thereof and having a substantially semi-circular slot formed therein located having one end of the slot being closer to the axis of rotation of the cam than the other end of the slot, and means for extending from the wire guide engaged in said slot whereby rotation of the cam causes movement of the wire guide between said extended and retracted position.

2. A staple gun tacker as defined in claim 1 wherein the angular arc of said slot is greater than 180°.

3. A staple gun tacker as defined in claim 1 wherein the angular arc of said slot is between 180° and 210°.

4. The staple gun tacker as defined in claim 1 wherein said means for engaging said slot is an integral protuberance on the wire guide.

5. In a staple gun tacker for driving staples having a housing, including a staple driving end, a staple discharge opening side walls, and staple driving means for driving staples for one said staple driving end, the improvement comprising, said housing having openings in the side walls thereof adjacent said staple driving end, a wire guide slidably mounted in the staple driving end of the housing adjacent said opening for linear movement between extended and retracted positions relative the staple discharging opening, said wire guide having a free end including a recess for receiving a wire to be stapled to a workpiece, said free end being located outside the housing and beneath the driving end thereof in the extended position of the wire guide and adjacent the discharging opening in the retracted position;

cam means for moving said wire guide linearly between said extended and retracted positions comprising a cam member rotatably mounted in the housing for rotation on an axis perpendicular to the path of travel of the wire guide and having: (i) a peripheral edge portion which extends laterally out of the openings in the housing side walls to permit manual rotation thereof and (ii) a substantially semicircular slot formed therein lying in a plane parallel to the path of travel of the wire guide with one end of the slot being located close to the axis of rotation of the cam than the other end of the slot, and means extending from the wire guide for engaging in the slot whereby rotation of the cam means causes movement of the wire guide between said extended and retracted positions.

6. A staple gun tacker as defined in claim 5 wherein said free end of said wire guide has a pair of support surfaces respectively located on either side of said recess.

7. A staple gun tacker as defined in claim 5 wherein the angular arc of said slot is greater than 180°.

8. A staple gun tacker as defined in claim 5 wherein the angular arc of said slot is between 180° and 210°.

9. The staple gun tacker as defined in claim 5 wherein said means for engaging said slot is an integral protuberance on the wire guide.

10. As staple gun tacker as defined in claim 5 wherein said means for engaging said slot and the ends of the slot are shaped to be generally complementary thereby to engage in a function fit to hold the wire guide in place at the extended and retracted positions thereof.

11. A staple gun tacker as defined in claim 5 wherein the periphery of said cam is knurled.

* * * * *

UNITED STATES PATENT AND TRADEMARK OFFICE

CERTIFICATE OF CORRECTION

PATENT NO. : 8,240,535 B2
APPLICATION NO. : 12/946496
DATED : August 14, 2012
INVENTOR(S) : Ilya Shor It is certified that error appears in the above-identified patent and that said Letters Patent is hereby corrected as shown below:

Column 4, Line 27, Claim 1:

After "slot formed therein"
Delete "located".

Signed and Sealed this
Thirteenth Day of November, 2012

David J. Kappos

David J. Kappos
*Director of the United States Patent and Trademark Office*